United States Patent [19]

Rozmus

[11] 4,406,671

[45] * Sep. 27, 1983

[54] ASSEMBLY AND METHOD FOR ELECTRICALLY DEGASSING PARTICULATE MATERIAL

[75] Inventor: Walter J. Rozmus, Traverse City, Mich.

[73] Assignee: Kelsey-Hayes Company, Romulus, Mich.

[ * ] Notice: The portion of the term of this patent subsequent to Jul. 5, 2000 has been disclaimed.

[21] Appl. No.: 322,025

[22] Filed: Nov. 16, 1981

[51] Int. Cl.[3] ..... B03C 9/00; B65B 31/02

[52] U.S. Cl. ..... 55/2; 55/100; 55/136; 55/152; 55/410; 209/127 R; 141/44; 134/21; 417/49; 361/226

[58] Field of Search ..... 55/2, 3, 6, 100, 101, 55/136–138, 145, 152, 385 R, 422, 424, 432, 410, 419, 356, 357, 128, 129; 209/1, 3, 9, 127 R, 127 C, 143; 141/65, 66, 44; 34/92, 102; 134/1, 21, 25.1, 25.4; 417/48, 49; 361/226

[56] References Cited

U.S. PATENT DOCUMENTS

| | | | |
|---|---|---|---|
| 1,357,466 | 11/1920 | Möller | 55/138 |
| 2,556,982 | 6/1951 | Roos et al. | 55/131 |
| 2,701,621 | 2/1955 | Sprague | 55/131 |
| 3,555,818 | 1/1971 | Vlier | 55/152 |
| 3,616,606 | 11/1971 | Vincent | 55/131 |
| 3,786,130 | 1/1974 | Baker | 141/65 |
| 4,056,368 | 11/1977 | Rozmus | 55/2 |

*Primary Examiner*—David L. Lacey

*Attorney, Agent, or Firm*—Harold W. Milton, Jr.

[57] ABSTRACT

Gas-contaminated particulate material is passed through a vacuum chamber wherein it is subjected to an electric field to charge the gaseous contaminants to cause the gaseous contaminants to separate from the particulate material and enter a gas flow path through a vacuum-outlet conduit inflow communication with a vacuum source. A series of electrical potentials are established in the vacuum outlet conduit by a series of electrodes spaced from one another. Adjacent potentials or electrodes are of opposite polarity and the distance between adjacent potentials or electrodes decreases in the direction of the gas flow path out the vacuum outlet conduit whereby the vacuum and the electrodes move the gases from the vacuum chamber.

16 Claims, 9 Drawing Figures

ASSEMBLY AND METHOD FOR ELECTRICALLY DEGASSING PARTICULATE MATERIAL

TECHNICAL FIELD

This invention relates to an assembly for degassing or cleaning particulate material which is at least in part contaminated by gas.

The invention is particularly useful in the field of powder metallurgy, specifically, for preparing metal powders of the superalloy type for consolidation, i.e., densification under heat and pressure. A substantial portion of the powders are produced in an inert atmosphere, for example, argon. However, before the powder is consolidated or densified, it is necessary to remove the inert gas from the powder.

A significant advance in the degasification of powdered metal was made by the inventor named herein, Walter J. Rozmus, his invention being described and claimed in U.S. Pat. No. 4,056,368 granted Nov. 1, 1977. In accordance with that invention, degasification is accomplished by introducing gas-contaminated particulate material into a vacuum chamber which is connected to a vacuum pump. One or more electric fields are established within the vacuum chamber by applying a potential across one or more sets of electrodes. The electrical field charges the gas contaminants and excites then so that the gas contaminants are separated from the particulate material and are thus more easily removed from the vacuum chamber. Such is accomplished by placing a container filled with gas-contaminated particulate material above the vacuum chamber and connecting the container to the vacuum chamber so that the particulate material may flow downwardly under the force of gravity through the vacuum chamber and into a receiver container, the receiver container being sealed and removed from the apparatus so that the degasified powder therein remains under a vacuum for further processing. Most often, one pass of the gas-contaminated particulate powdered metal through the vacuum chamber does not sufficiently degas the powdered metal. In such a case, the containers must be disconnected from the bottom of the vacuum chamber and repositioned above the vacuum chaber with the entire assembly sequenced to initiate a new operational mode.

In order to solve that problem, the inventor named herein, Walter J. Rozmus, conceived an invention for degassing particulate material by multiple passes of the material through a vacuum chamber between containers at each end of the vacuum chamber wherein the vacuum chamber and the containers may be cycled or flip flopped back and forth through an arc of 180° to continually pass the gas-contaminated particulate material back and forth through the vacuum chamber until the particulate material has reached the desired level of degasification. That invention is described and claimed in U.S. application Ser. No. 267,729 filed May 28, 1981 now U.S. Pat. No. 4,348,212 granted Sept. 7, 1982, in the name of Walter J. Rozmus and assigned to the assignee of the subject invention.

As part of the development of the concept of the cyclic or flip flop degasser utilizing a vacuum chamber which may be rotated end for end, significant effort was expended to provide an electric field-producing system which would most effectively charge or ionize the gases to provide the most efficient and effective degassing of the particulate material in a vacuum chamber. The subject invention provides such an efficient and effective electric field-producing method and an assembly for performing same to efficiently and effectively degas gas-contaminated particulate material.

STATEMENT OF INVENTION AND ADVANTAGES

Gas-contaminated particulate material is passed through a vacuum chamber wherein it is subjected to an electric field to charge the gaseous contaminants to cause the gaseous contaminants to separate from the particulate material and enter a gas flow path through a vacuum-outlet conduit to the vacuum source. A series of electrical potentials are established in the vacuum outlet by a series of electrodes spaced from one another. Adjacent potentials or electrodes are of opposite polarity and the distance between adjacent potentials or electrodes decreases in the direction of the gas flow path out the vacuum outlet.

Because of the establishment of the electrical potentials in accordance with the subject invention, there is established a gas flow path wherein the gas molecules are continually urged by the electrical potentials to move in the direction of the gas flow path. In other words, the establishment of the potentials continually urges the gas molecules to move along the gas flow path toward the vacuum source such that the molecules are trapped or prevented from moving upstream back into the vacuum chamber. This, of course, provides very efficient and most effective removal of gas contaminants from the particulate material within the vacuum chamber.

FIGURES OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
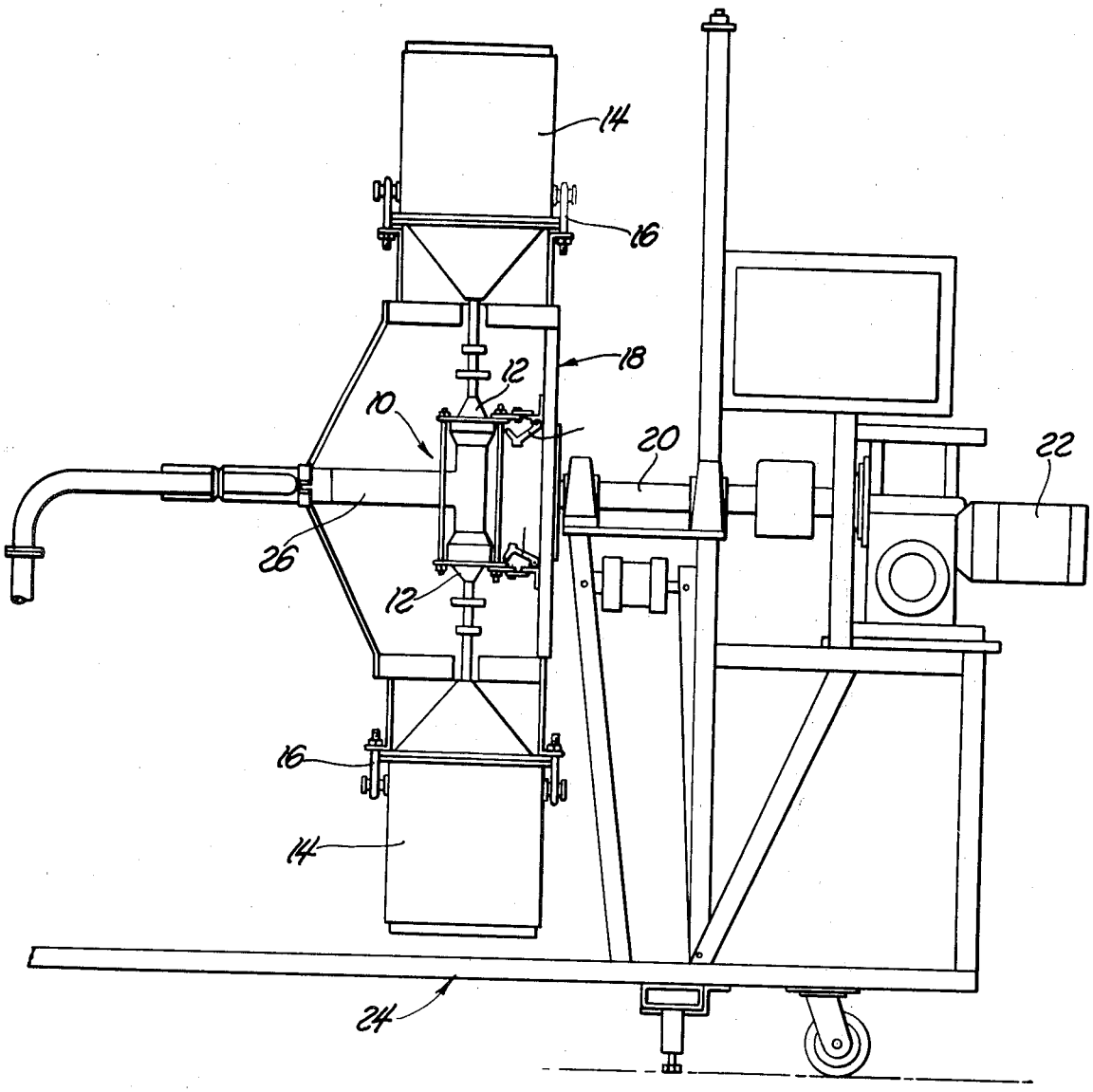
FIG. 1 is a side-elevational view of an assembly utilizing the subject invention.

FIG. 1 discloses an assembly of the type more specifically described and claimed in the above-mentioned application Ser. No. 267,729 filed May 28, 1981. Broadly, the assembly shown in FIG. 1 includes a vacuum chamber assembly generally indicated at 10. The assembly 10 includes flow passages 12 at the respective ends thereof which are, in turn, connected to the containers 14. The containers 14 are identical and are connected by the assembly 16 to a framework generally indicated at 18 which may be flip flopped or rotated back and forth through 180° by a shaft 20 driven by a motor 22, all of which are supported by a structure generally indicated at 24. The vacuum chamber assembly 10 has a horizontal vacuum-outlet conduit 26.

Figure 2:
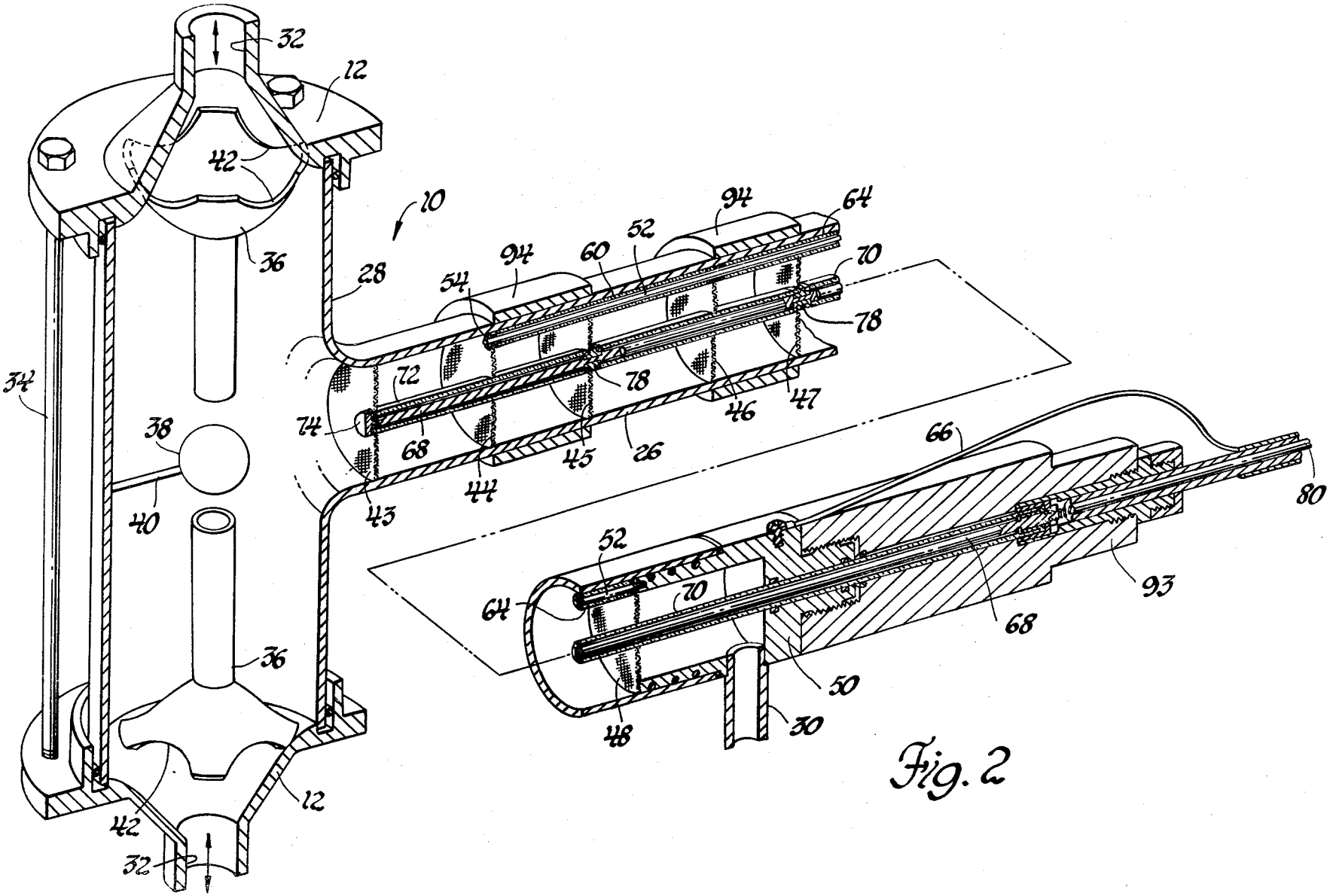
FIG. 2 is a perspective view partially broken away and in cross section of one embodiment of the subject invention.
Figure 3:
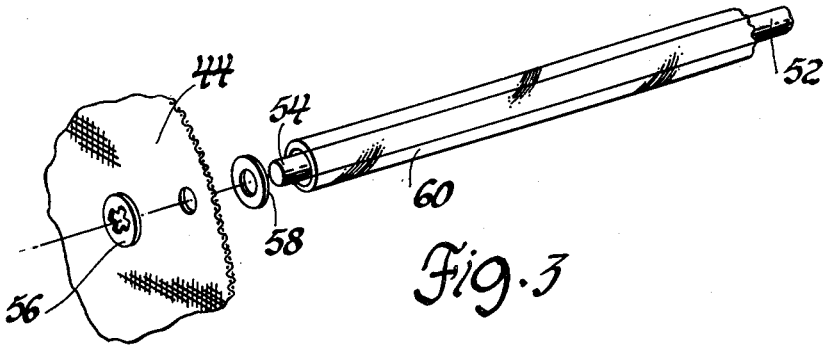
FIG. 3 is an enlarged fragmentary exploded view showing the connection between one of the electrodes and a conductor.

A first embodiment of the subject invention is shown in FIG. 2 and includes a vacuum chamber assembly generally shown at 10 including the vacuum gas outlet conduit 26. The assembly 10 cleans particulate material which is at least in part contaminated by gas. The vacuum chamber 10 is defined by a glass tube 28 integrally formed with a glass tubular member 26 defining the vacuum outlet conduit which is connected by a pipe 30 to a vacuum source such as vacuum pump. Metal end caps 12 define flow passages 32 at opposite ends thereof. The tube 28 as in sealing engagement with the caps 12 through appropriate seals with the caps 12 being urged against the ends of the tube 28 by tie rods 34 which interconnect the caps 12.

A pair of funnel-shaped members 36 are disposed at opposite ends of the chamber and may be held in position by an appropriate positioning means such as by being glued to the end cap members 12. The small outlet openings of the funnel members 36 are aligned with one another and spaced above and below the dispersal ball 38 which is supported by an arm 40 glued or otherwise secured to the interior of the tube 28.

As powder enters the flow passage 32 at the top of the assembly, it enters the open large end of the funnel-shaped member 36 and passes downwardly through the small outlet to engage the dispersing ball 38 which disperses the flow of particulate material into a circular curtain about and exteriorly of the small opening of the funnel-shaped member 36 disposed at the bottom of the chamber. The powder then is dispersed into a wide curtain and falls upon the conical outwardly flared portion of the funnel-shaped member 36 and falls out the scalloped openings 42 and out through the bottom opening 32. As alluded to hereinbefore, the chamber assembly 10 may be flip flopped or rotated end-for-end so that the particulate material will flow back through the assembly in the same manner.

Disposed within the vacuum outlet conduit 26 is an electric field-producing means for producing an electric field to subject the gas-contaminated particulate material falling through the tube 28 to the electric field to electrically charge the gaseous contaminants and cause separation of the gaseous contaminants from the particulate material to facilitate removal of the gaseous contaminants from the vacuum chamber through the gas outlet conduit 26 to the vacuum source through the conduit 30. The invention is characterized by including a series of electrodes 43, 44, 45, 46, 47 and 48 spaced from one another generally along the path of gas flow from the chamber defined by the tube 28 through the outlet conduit 26 to the vacuum source though the conduit 30. Adjacent ones of the electrodes are oppositely charged and the distance between adjacent electrodes decreases in the direction of the path of gas flow out the outlet conduit 26. All of the electrodes 43, 44, 45, 46, 47 and 48 are disposed within the gas outlet conduit 26 and completely out of the vacuum chamber defined by the tube 28, the gas outlet conduit 26 extending generally horizontally from the mid length of the vacuum chamber.

Figure 4:
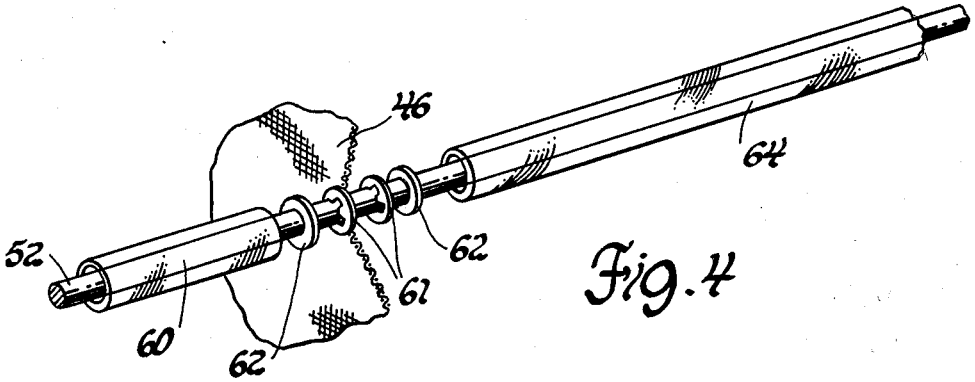
FIG. 4 is a fragmentary, exploded and perspective view showing the connection between another of the electrodes and the same conductor shown in FIG. 3.

As alluded to above, the gas outlet conduit 26 is of an electrically nonconductive material such as glass and extends from the vacuum chamber assembly to a metal connector member 50. A first conductor means in the form of one or more rods 52 extend from the connector member 50 within the gas outlet conduit 26. The end of the rod 52 has threads which threadally engage an annular end face of the member 50. The end of the glass tube forming the outlet conduit 26 is disposed over the exterior of the member 50 and is in sealing engagement therewith, the end of the conduit 26 abutting a shoulder formed in the member 50. A first plurality of the electrodes, to wit, electrodes 44, 46 and 48, are spaced along the rod 52 and are electrically interconnected thereby. The electrodes take the form of circular screens or metal mesh, i.e., interwoven metal strands. The conductor rod 52 extends to an end 54 in conductive engagement with the screen 44 as a Belleville-type washer 56 engages the end 54 of the rod 52 on one side of the screen 44 and a washer 58 is disposed on the other side of the screen. An insulating glass tube 60 extends between the electrodes 44 and 46 to isolate the rod 52 from the interior of the outlet conduit 26 and to isolate it from the electrode 45 of opposite polarity . The glass tube 60 forces the washer 58 against the screen 44. As best shown in FIG. 4, the screen defining the electrode 46 is in electrical contact with the rod 52 as a pair of Belleville washers 61 grip the rod 52 on either side of the screen 46 with washers 62 disposed outboard of the Belleville washers 61 with one washer 62 engaged by the insulating tube 60 and the other engaged by the insulating tube 64. The opposite end of the tube 64 engages the electrode 48 and urges it against the end face of the connector member 50. A line or electrical lead 66 preferably grounds or neutralizes the member 50 whereby the alternate or every other electrode of the first plurality including the electrodes 48, 46 and 44 are all grounded. Although only one rod 52 is shown, that is merely for convenience because in the preferred embodiment three such rods would be utilized with them being spaced circumferentially one hundred twenty degrees (120°) from one another. The remaining electrodes 43, 45 and 47 form a second plurality of electrodes spaced along the gas outlet conduit 26. Each of these second plurality of electrodes 43, 45 and 47 are spaced between two adjacent of the other electrodes 44, 46 and 48.

Figure 5:
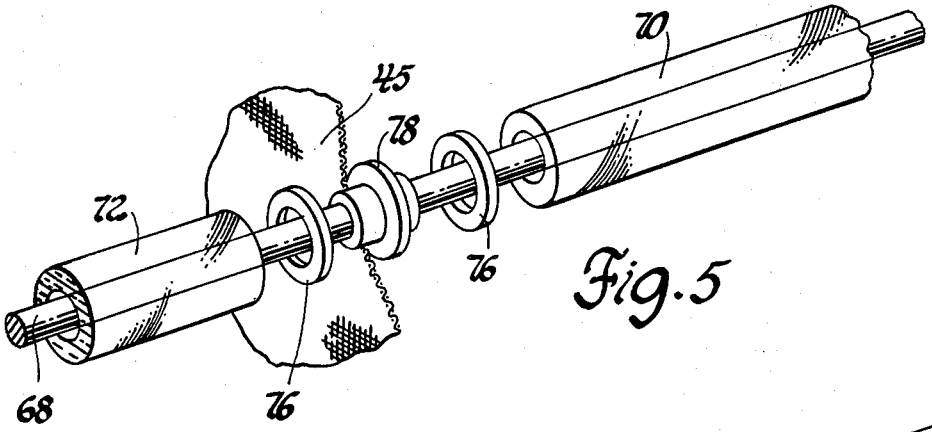
FIG. 5 is a fragmentary, exploded and perspective view of the connection between one of the other electrodes and another conductor.
Figure 6:
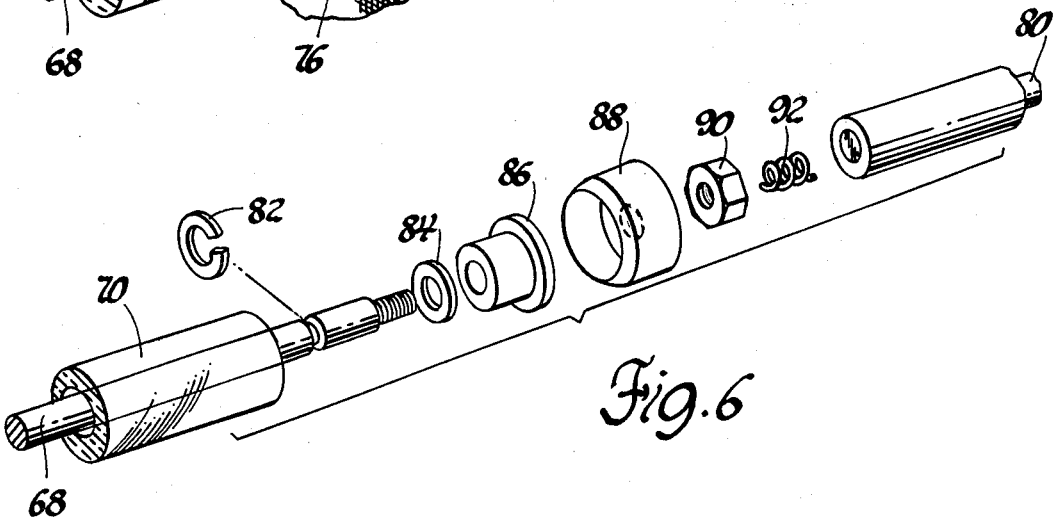
FIG. 6 is a fragmentary, exploded and perspective view of a terminal connection for the conductor shown in FIG. 5.

A second conductor means in the form of a shaft 68 electrically interconnects the second plurality of electrodes 43, 45 and 47 so that they are charged or establish a potential relative to the other electrodes 44, 46 and 48. In other words, the electrodes 44, 46 and 48 may be grounded whereas the other alternate electrodes 43, 45 and 47 may be either positively or negatively charged. In accordance with the description herein, when it is stated that the alternate electrodes or adjacent electrodes are oppositely charged this means that there is an electrical potential established between adjacent electrodes. The shaft 68 is an electrical conductor (preferably of metal) and is insulated by the glass insulating tubes 70 and 72. The shaft extends from the connector member 50 in a cantilevered fashion to the electrode 43 at the distal end thereof adjacent the vacuum chamber. A cap 74 threadally engages the end of the shaft 68 to abut the end of the insulating tube 72 and retain the electrode 43 in position and in electrical contact with the shaft 68. The insulating tube 72 extends through the next adjacent electrode 44 to a connection with the electrode 45 which is best illustrated in FIG. 5. A conductive member or ring 78 has one flange in engagement with one side of the screen of electrode 45 and is urged thereagainst between two washers or O-rings 76 which are abutted by the respective ends of the insulating tubes 70 and 72. The shaft 68 is in electrical contact with another shaft 80 through the assembly shown in FIG. 6 which includes a snap ring 82 to be disposed in a groove in the shaft 68 to engage the end of the insulating member 70 with the end of the shaft 68 being threaded and extending through a washer 84 and members 86 and 88 to threadally engage a nut 90 with the end of the shaft 68 engaging an electrical contact with a spring 92 which, in turn, contacts the shaft 80. Thus, the insulating tube 70 extends through the connector member 50 to isolate the shaft 68 from the connector member 50. The electrically conductive member 50 is supported by a nonconductive member 93 such as a member made of Lucite. In the preferred embodiment a positive electrical potential is supplied to the shaft 68 so that the electrodes 43, 45 and 47 are positively charged.

Also included are a plurality of magnets extending between adjacent but oppositely charged electrodes. The first magnet 94 extends between the electrode 44 and the next adjacent oppositely charged electrode 45. The other magnet 94 extends between the electrode 46 and the next adjacent oppositely charged electrode 47. The magnets 94 establish lines of flux to affect the movement of the ionized or charged gas molecules so that they continue to move in the flow path toward the vacuum source.

The distance from the electrode 48 to the next adjacent oppositely charged electrode 47 is less than the distance between the electrode 47 and the next adjacent oppositely charged electrode 46. Similarly, the distance between the electrode 46 and the electrode 45 is less than that between the electrodes 45 and 44 and so on. Accordingly, the distance between oppositely charged adjacent electrodes decreases in the direction of the gas flow to the vacuum source through the outlet conduit 26. The amount of decrease from electrode to electrode may vary; however, it has been found satisfactory to decrease the distance by a factor of approximately eight percent (8%) between successive electrodes.

The gases in the chamber defined by the tube 28 will be subjected to a difference of a potential established by the electrode 43. For example, the funnel-shaped members 36 may be grounded with the electrode 43 establishing a positive charge. The gas molecules are neutral and attracted to the positively charged electrode 43 which is lacking in electrons. The gas molecules pass through the screen of the electrode 43 and give up electrons and are positively charged and, therefore, attracted to the neutral or grounded electrode 44. Once they pass through the electrode 44, the molecules receive electrons from the ground and become neutralized; however, because the distance to the next positive electrode 45 is shorter than the distance back to the postive electrode 43, the molecules continue to move along the gas flow to the outlet. Additionally, the magnet 94 establishes a magnetic field or lines of flux which prevent the molecules positively charged by positive electrode 45 from returning to the grounded electrode 44. In other words, some randomly moving molecules positively charged by positive electrode 45 may move back toward grounded electrode 44 but the magnetic lines of flux prevent such movement. And the same occurs as the gas molecules pass from electrode to electrode, i.e., the distance between adjacent electrodes 43, 44, 45, 46, and 47 becomes decreasingly less thereby establishing continued flow of the gas molecules.

Figure 7:
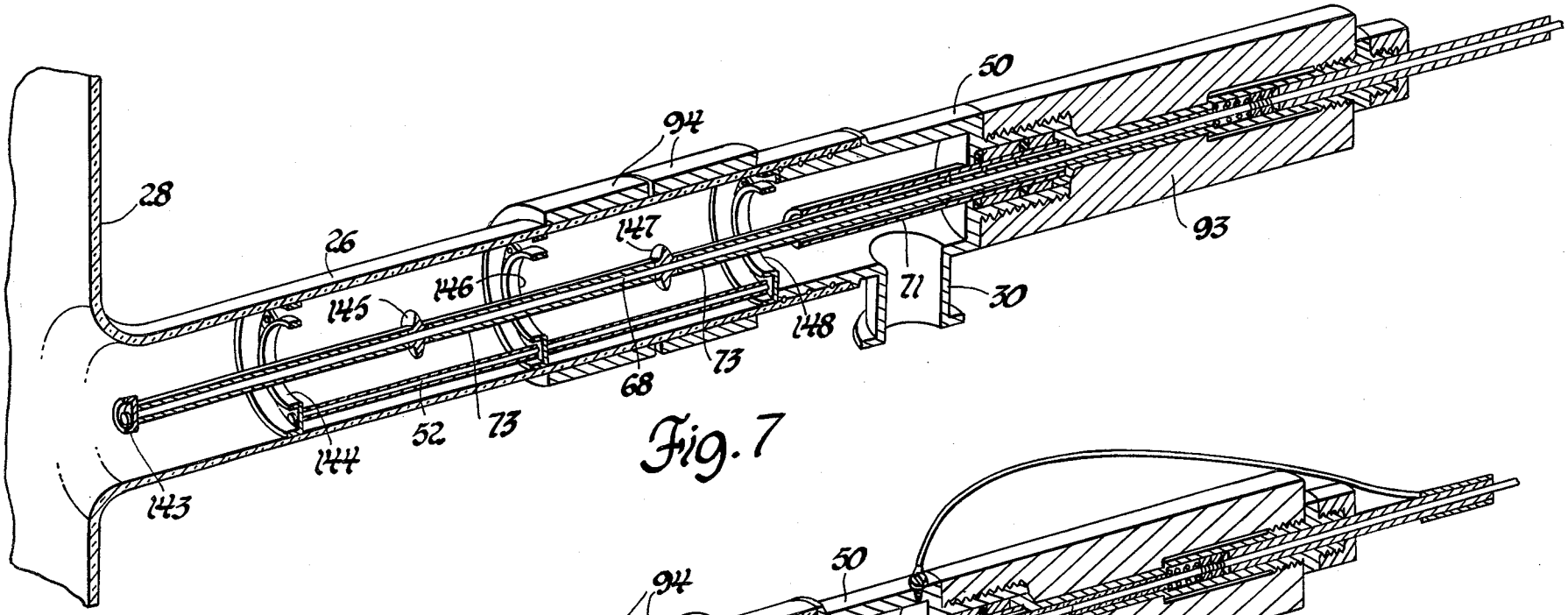
FIG. 7 is a perspective view partially broken away and in cross section of another embodiment of the subject invention.

The embodiment of FIG. 7 includes the same components as the embodiment of FIG. 2 designated with the same reference numerals but differs only in the configuration of the electrodes. In the embodiment of FIG. 7, the positively charged electrodes 145 and 147 are small disc-shaped members having a sharp circular or annular edge for emitting electrons. The electrode 143 at the distal end of the shaft 68 is preferably cup-shaped with its periphery being corrugated or having sharp teeth for facilitating the emission of electrons. The electrodes 143, 145 and 147 are separated by glass insulating tubes 73 as hereinbefore described. An additional insulating tube 71 extends through the metal support member 50 to prevent electrical interaction between the shaft 68 and the support member 50.

The first plurality of electrodes 144, 146 and 148 of the embodiment of FIG. 7 each comprise a pair of concentric rings interconnected by radial bridges. The first conductor defined by the rod 52 interconnects the radial bridges of adjacent electrodes 144, 146 and 148 so as to ground these electrodes to the connector or support member 50.

Figure 8:
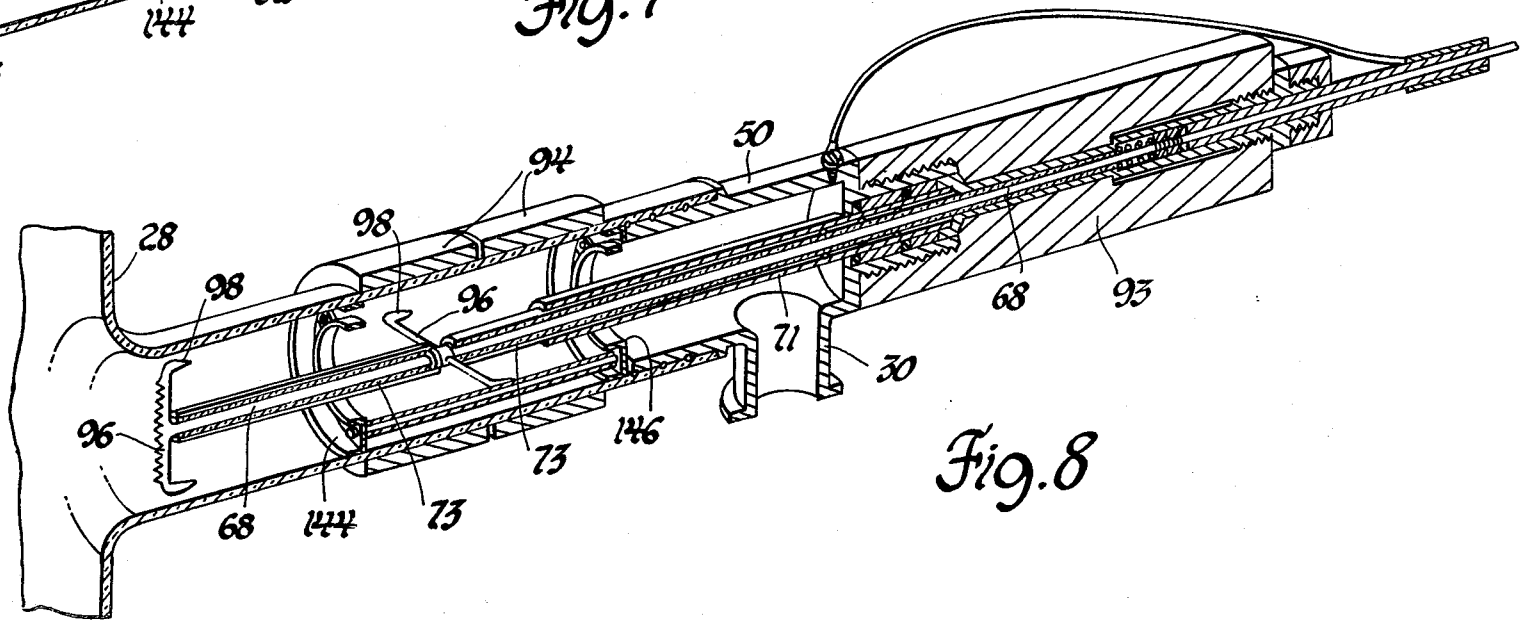
FIG. 8 is a perspective view partially broken away and in cross section of another embodiment of the subject invention.

The embodiment of FIG. 8 differs from the embodiment of FIG. 7 by the number of electrodes which may vary and in that the positively charged electrodes of the first plurality comprises a cross shaft 96 extending from opposite sides or radially from the shaft 68 and includes spikes 98 extending in the direction of the gas flow path from each end of the cross shafts 96. In the case of the first electrode disposed at the distal end of the shaft 68 adjacent the vacuum chamber, the cross shaft includes forwardly pointing teeth or serrations to provide sharp points for emitting electrons.

Figure 9:
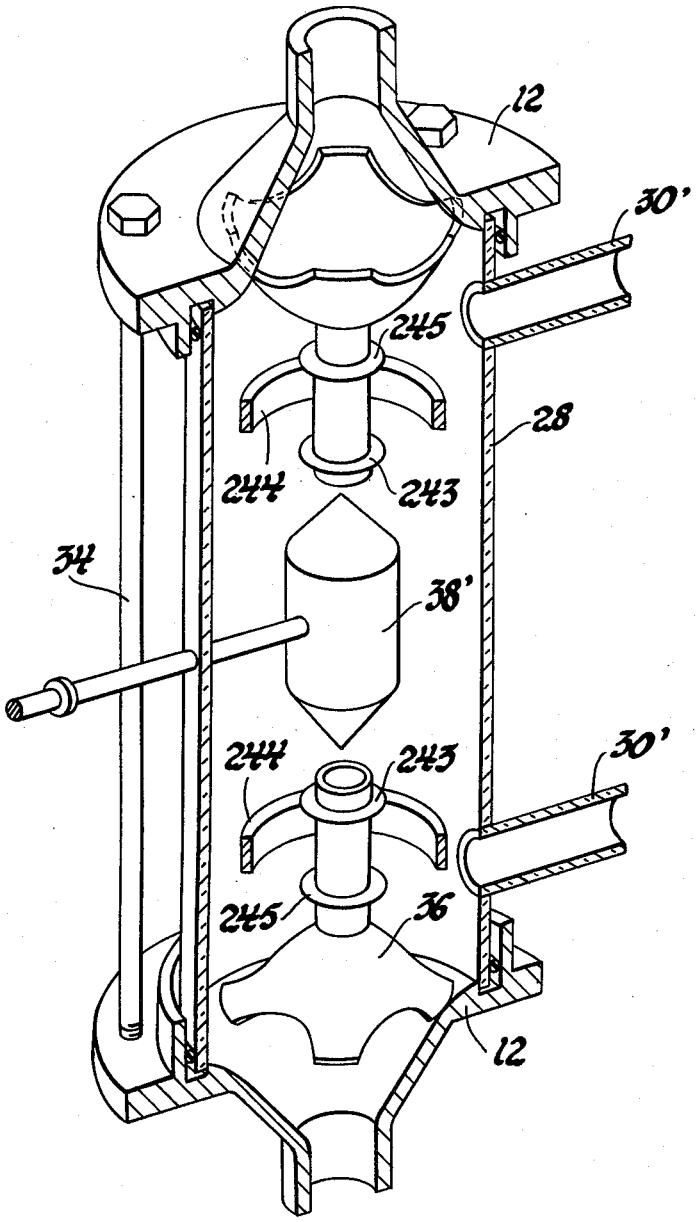
FIG. 9 is a perspective view partially broken away and in cross section of yet another embodiment of the subject invention.

The embodiment of FIG. 9 includes vacuum conduits 30' in communication with the vacuum source and differs with the previous embodiments in that the electrodes are disposed within the vertical vacuum chamber defined by the tube 28. In accordance with the invention there are provided positively charged electrodes 243 and 245 disposed about the exterior of the funnel-shaped members 36 and being electrically insulated in regard thereto. Disposed between the electrodes 243 and 245 is a grounded electrode 244. The distance between the electrode 243 and the electrode 244 is greater than the distance between the electrode 244 and the electrode 245, they being serially oppositely charged. The divider or dispersal member 38' could also be grounded. Thus, when particulate material is entering into the top of the assembly shown in FIG. 9, only the topmost components and the top vacuum conduit 30' would be operating to establish a gas flow from the member 38' upwardly through the uppermost vacuum outlet conduit 30'.

Thus, in accordance with the invention there is provided a method of degassing gas-contaminated particulate material wherein gas-contaminated particulate material is passed through a vacuum chamber defined by glass tube 28 which is continually subjected to a vacuum source through a vacuum outlet conduit while subjecting the gas-contaminated particulate material to an electric field to charge the gaseous contaminants, thus causing the gaseous contaminants to separate from the particulate material and establish a gas flow path through the outlet conduit to the vacuum source, the method being characterized by establishing a series of electrical potentials spaced from one another generally along the gas flow path to the vacuum source with adjacent potentials being of opposite polarity and with the distance between adjacent potentials decreasing in the direction of the gas flow path. In the embodiments of FIGS. 2, 7 and 8, the electrical potentials are established within the outlet conduit 26 extending from the chamber and out of the vacuum chamber, whereas in the embodiment of FIG. 9 the electrical potentials are established within the vacuum chamber.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. An assembly for cleaning particulate material which is at least in part contaminated by gas, said assembly comprising; a vacuum chamber (28) and a gas outlet conduit extending from said vacuum chamber for connection to a vacuum source, said vacuum chamber having vertically spaced first and second ends with a flow passage at each end for directing the flow of the particulate material into and out of said chamber, electric field-producing means for producing an electric field to subject the gas-contaminated particulate material to the electric field to electrically charge the gaseous contaminants and cause separation of the gaseous contaminants from the particulate material to facilitate removal of the gaseous contaminants along a path of gas flow from said vacuum chamber through said gas outlet conduit wherein said electric field-producing means includes a series of electrodes (43, 44, 45, 46, 47, 48, 143, 145, 146, 147, 148, 143, 245, 246) spaced from one another generally along the path of gas flow from said vacuum chamber through said gas outlet conduit with adjacent electrodes in the series along the path being oppositely charged and the distance between said adjacent electrodes along the series decreasing in the direction of the path of gas flow.

2. An assembly as set forth in claim 1 wherein said gas outlet conduit (26) extends generally horizontally from said vacuum chamber (28) and said electrodes are disposed within said gas outlet conduit (26) and out of said vacuum chamber (28).

3. An assembly as set forth in claim 2 including a connector member (50), said gas outlet conduit (26) being of an electrically nonconductive material extending from said vacuum chamber (28) to said connector member (50), said electric field-producing means including a first conductor means (52) extending from said connector member (50) within said gas outlet conduit (26), a first plurality of said electrodes (44, 46, 48, 144, 146, 148) spaced along said first conductor means (52) and electrically interconnected thereby.

4. An assembly as set forth in claim 3 further including a second plurality of said electrodes (43, 45, 47, 143, 145, 147) spaced along said gas outlet conduit (26) with each of said second plurality of electrodes spaced between two adjacent electrodes of said first plurality, said electric field-producing means including second conductor means (68) electrically interconnecting said second plurality of electrodes so that said first and second plurality of electrodes are oppositely charged.

5. An assembly as set forth in claim 4 wherein said second conductor means (68) comprises a shaft (68) extending from said connector member (50) in a cantilevered fashion to one of said first plurality of electrodes at the distal end thereof adjacent said vacuum chamber (28).

6. An assembly as set forth in claim 4 including at least one magnet (94) extending between said adjacent oppositely charged electrodes.

7. An assembly as set forth in claim 6 wherein said shaft (68) is insulated from said connector member (50).

8. An assembly as set forth in claim 7 wherein said connector member (50) is of an electrically conductive material and said first conductor means (52) being electrically connected to said connector member.

9. An assembly as set forth in any one of claims 1, 5 or 8 including at least one magnet (94) extending between said adjacent oppositely charged electrodes.

10. An assembly as set forth in claim 8 wherein said second plurality of electrodes (143, 145, 147) have sharp edges for emitting electrons.

11. An assembly as set forth in claim 10 wherein said second plurality of electrodes each comprise a cross shaft (96) extending from opposite sides of said shaft (68) with a spike (98) extending transversely to said shafts from each end of said cross shafts.

12. An assembly as set forth in claim 8 wherein each of said first plurality of electrodes (144, 146, 148) comprises a pair of concentric rings interconnected by radial bridges.

13. An assembly as set forth in claim 12 wherein said first conductor means comprises at least one conductor rod (52) interconnecting said radial bridges of adjacent electrodes of said first plurality thereof.

14. A method of degassing gas-contaminated particulate material wherein gas-contaminated particulate material is passed through a vacuum chamber which is continuously subjected to a vacuum source through a vacuum outlet conduit while subjecting the gas-contaminated particulate material to an electric field to charge the gaseous contaminants, thus causing them to separate from particulate, material and establish a gas flow path through the outlet conduit to the vacuum source, the method further comprising establishing a series of electrical potentials spaced from one another generally along the gas flow path to the vacuum source with adjacent potentials in the series along the path being of opposite polarity and with the distance between the adjacent potentials along the series decreasing in the direction of the gas flow path to the vacuum source.

15. A method as set forth in claim 14 including establishing the series of electrical potentials within the outlet conduit and out of the vacuum chamber.

16. A method for facilitating the removal of gases from a chamber having a gas outlet conduit in flow communication with a vacuum source comprising the steps of subjecting the gases to an electric field to charge the gases and establish a gas flow path through the outlet conduit, the method further comprising establishing a series of electrical potentials spaced from one another generally along the gas flow path to the vacuum source with adjacent potentials being of opposite polarity and with the distance between adjacent potentials decreasing in the direction of the gas flow path.

* * * * *